US006262285B1

(12) United States Patent
McDonald

(10) Patent No.: US 6,262,285 B1
(45) Date of Patent: Jul. 17, 2001

(54) PROCESS FOR DRY SYNTHESIS AND CONTINUOUS SEPARATION OF A FATTY ACID METHYL ESTER REACTION PRODUCT

(75) Inventor: William M. McDonald, Maplewood, MN (US)

(73) Assignee: Crown Iron Works Company, Minneapolis, MN (US)

( * ) Notice: Subject to any disclaimer, the term of this patent is extended or adjusted under 35 U.S.C. 154(b) by 0 days.

(21) Appl. No.: 09/339,436

(22) Filed: Jun. 24, 1999

(51) Int. Cl.[7] ..... C11C 1/00
(52) U.S. Cl. ..... 554/169; 554/216
(58) Field of Search ..... 584/216, 169

(56) References Cited

U.S. PATENT DOCUMENTS 5,424,467 * 6/1995 Bam et al. ..... 554/216

* cited by examiner

*Primary Examiner*—Deborah D. Carr
(74) *Attorney, Agent, or Firm*—Nawrocki, Rooney & Sivertson P.A.

(57) ABSTRACT

A continuous separation of fatty acid methyl esters (FAME) from glycerol in a low pressure dry transesterification process for vegetable oil is provided. Improved purity of the FAME and the glycerol fractions are achieved via the use of continuous decantation so as to thereby eliminate the need for a water wash step for the FAME fraction. Excess methanol from the FAME and the glycerol fractions is readily recovered in a dry vacuum extraction process. Water which has been inadvertently introduced into the process is removed from the recovered excess methanol by desiccant columns equipped with molecular sieves instead of the traditional energy and capital intensive fractionation processes practiced for this purpose.

6 Claims, 3 Drawing Sheets

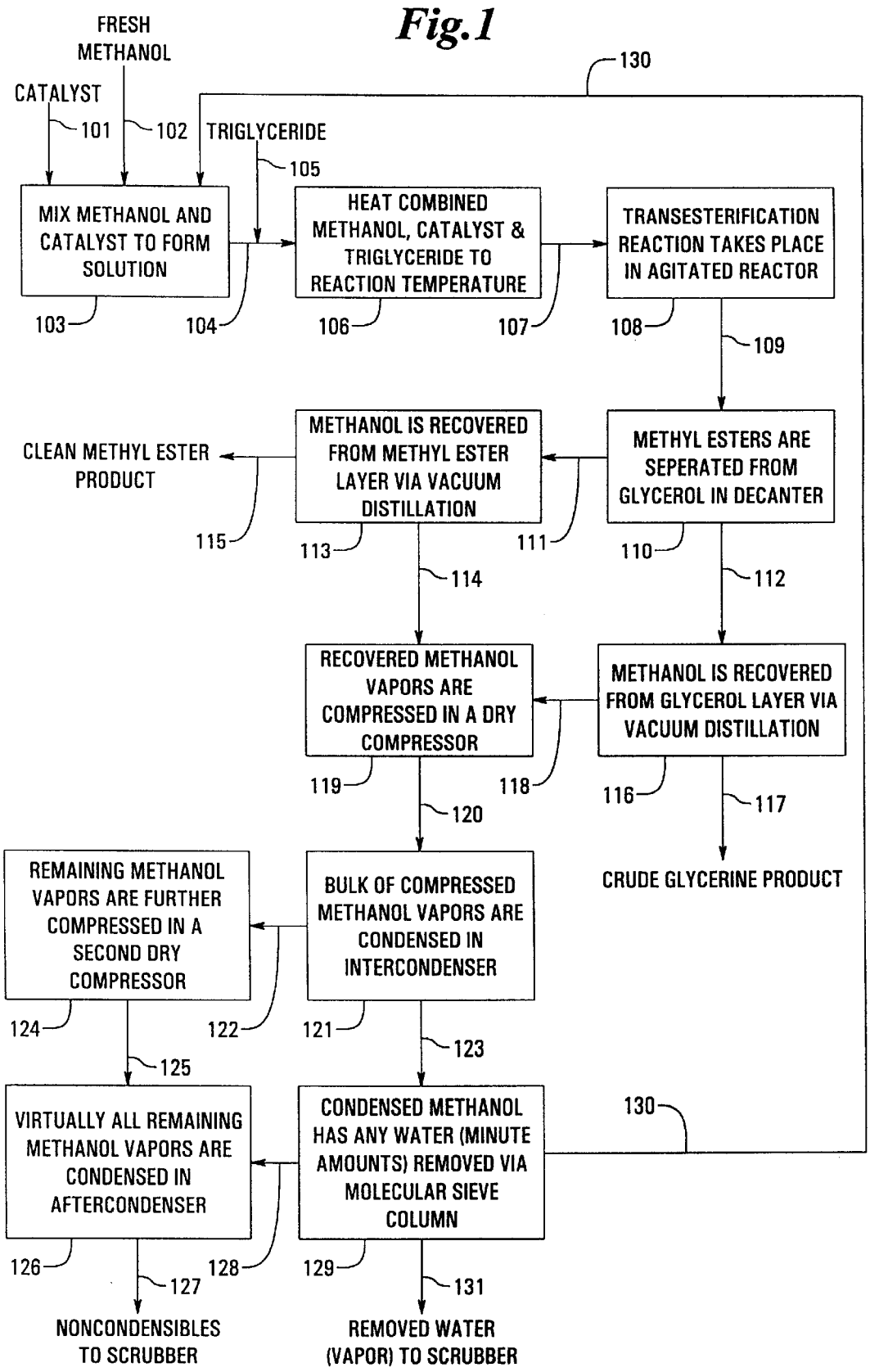
Fig.1
FRESH METHANOL
CATALYST
101
102
TRIGLYCERIDE
105
130
MIX METHANOL AND CATALYST TO FORM SOLUTION
HEAT COMBINED METHANOL, CATALYST & TRIGLYCERIDE TO REACTION TEMPERATURE
TRANSESTERIFICATION REACTION TAKES PLACE IN AGITATED REACTOR
103
104
106
107
108
109
METHANOL IS RECOVERED FROM METHYL ESTER LAYER VIA VACUUM DISTILLATION
METHYL ESTERS ARE SEPERATED FROM GLYCEROL IN DECANTER
CLEAN METHYL ESTER PRODUCT
115
113
111
110
114
112
RECOVERED METHANOL VAPORS ARE COMPRESSED IN A DRY COMPRESSOR
METHANOL IS RECOVERED FROM GLYCEROL LAYER VIA VACUUM DISTILLATION
119
118
116
117
120
CRUDE GLYCERINE PRODUCT
REMAINING METHANOL VAPORS ARE FURTHER COMPRESSED IN A SECOND DRY COMPRESSOR
BULK OF COMPRESSED METHANOL VAPORS ARE CONDENSED IN INTERCONDENSER
124
122
121
123
125
VIRTUALLY ALL REMAINING METHANOL VAPORS ARE CONDENSED IN AFTERCONDENSER
CONDENSED METHANOL HAS ANY WATER (MINUTE AMOUNTS) REMOVED VIA MOLECULAR SIEVE COLUMN
130
126
128
129
127
131
NONCONDENSIBLES TO SCRUBBER
REMOVED WATER (VAPOR) TO SCRUBBER

PROCESS FOR DRY SYNTHESIS AND CONTINUOUS SEPARATION OF A FATTY ACID METHYL ESTER REACTION PRODUCT

TECHNICAL FIELD

This invention relates to an improved process for the low pressure transesterification of triglycerides using excess methanol and an alkali catalyst, and in particular the continuous separation of fatty acid methyl esters (FAME) from glycerol and the recovery of excess methanol from the reaction products using a dry vacuum system.

BACKGROUND OF INVENTION

Prior processes for producing FAME by transesterification of triglycerides (i.e., natural oils) with excess methanol and alkali catalysts used batch decantation of the reaction products followed by a water wash of the FAME fraction to remove by-product glycerol therefrom. Where transesterification processes are practiced on a semi-continuous or continuous basis, water washing of glycerol, and often times methanol, from the FAME has been regularly practiced. Water washing produces an enriched FAME fraction, and a glycerol fraction containing excess methanol and water. In this type of process, excess methanol is ultimately rectified from the wash water via an expensive distillation step.

It would be desirable to provide a continuous low pressure transesterification process having low soap production and high conversion of triglycerides which does not include the introduction of water for washing glycerol from the FAME fraction.

SUMMARY OF THE INVENTION

The present invention provides a dry transesterification process to produce FAME from triglycerides. This dry transesterification process combines a feed solution of excess methanol and alkali catalysts with a triglyceride (e.g., vegetable oil) feed, and continuously separates the resulting FAME and glycerol fractions by a continuous decantation process, thus obviating the required practice of a water wash step, or steps, for FAME purification (i.e., glycerol removal). This selectively continuous process of separating the reaction products eliminates the costly washing step, and those further steps associated with such processing, because continuous separation is more efficient than batch decantation, yielding reaction products of greater purity. No additional water is introduced into the system since water washing has been eliminated in the present invention and because the vacuum system used to recover the methanol from the FAME and glycerol products is also dry. This permits the use of a molecular sieve column to eliminate the minute amounts of water present in the excess methanol, whether the water comes from air leaks into the system or from moisture in the natural oil feed etc., rather than rectification of the excess methanol from the wash water using distillation as in the batch approach. Desiccant columns equipped with molecular sieves are used to dry the recovered excess methanol.

The improved process begins with the combination and agitation of stored and recovered (i.e., recycled) excess methanol, with an alkali catalyst in a methanol/catalyst mixing tank to form a feed solution. Triglycerides from storage are added to the methanol/catalyst solution, with the combination then heated and pumped to a low pressure agitated reactor where the transesterification reaction occurs under appropriate process conditions. The reaction produces FAME and glycerol fractions, each of which contains a methanol component. The reaction fractions are delivered to a decanter for continuous separation.

The FAME fraction is pumped to a methanol stripping column which removes the included methanol therefrom while the FAME product is ultimately sent to storage. The other continuously separated output, namely, the glycerol fraction, is pumped to a separate methanol stripping column which removes the included methanol therefrom while the glycerine product is ultimately sent to storage. The excess methanol recovered from both the FAME and glycerol fractions is thereafter compressed, condensed and dried for recycling (i.e., feed for the methanol/catalyst solution).

BRIEF DESCRIPTION OF THE DRAWINGS

FIG. 1 is a flow chart depicting a low pressure dry transesterification process for the production of FAME utilizing excess methanol and an alkali catalyst wherein the FAME is continuously separated from a glycerol by-product.

DETAILED DESCRIPTION OF THE INVENTION

Figure 2A:
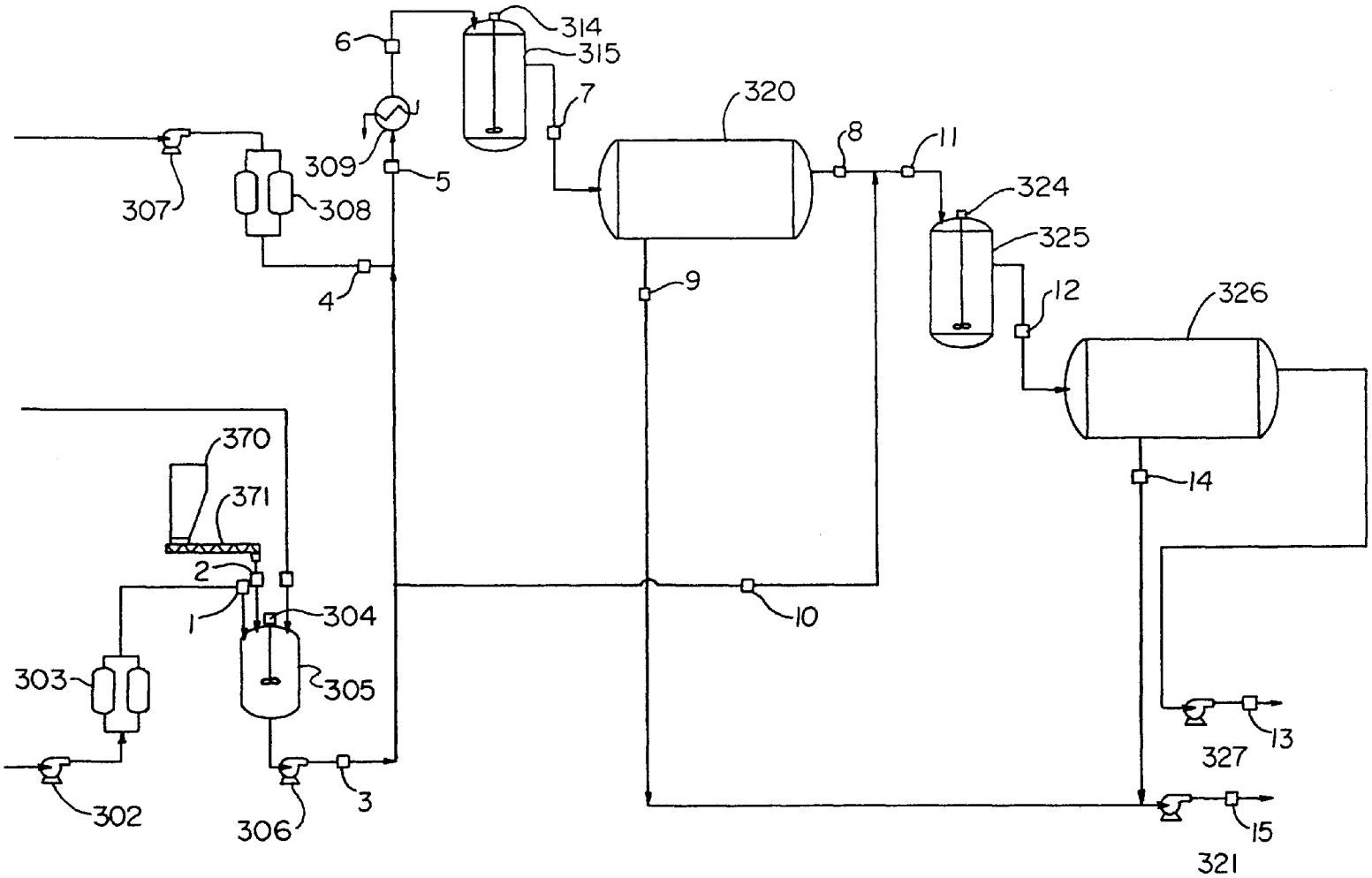
FIG. 2A is a process flow diagram depicting the apparatus associated with production of the FAME and glycerol fractions of FIG. 1, namely, the low pressure dry transesterification and continuous separation processes.
Figure 2B:
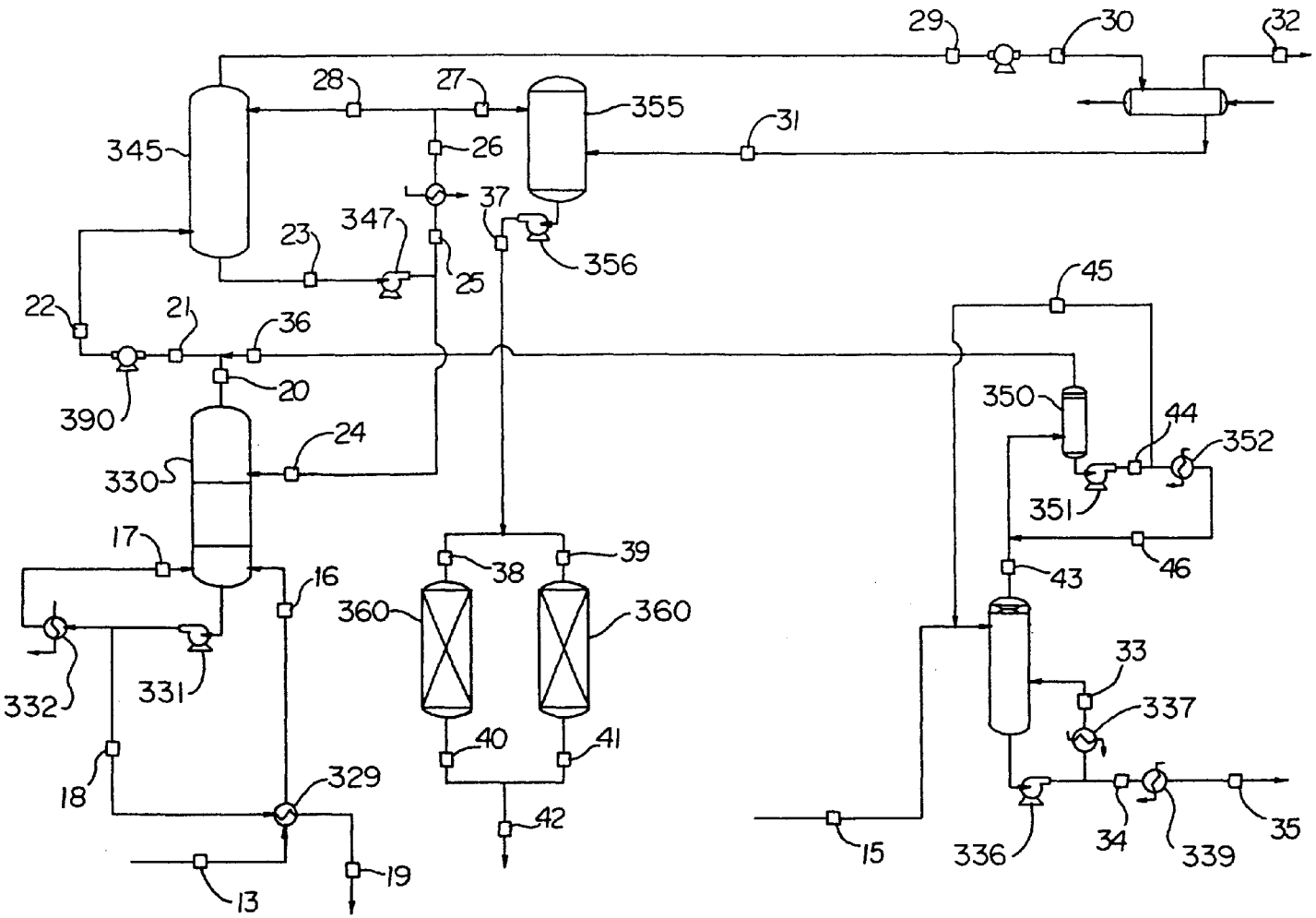
FIG. 2B is a process flow diagram depicting the apparatus associated with the purification of the dry tranesterification reaction products of FIG. 1, namely, the separation and recovery of excess methanol from the FAME and glycerol fractions.

The following description utilizes FIG. 1 which depicts the process steps associated with the low pressure dry transesterification of triglycerides in flow chart form. Process flow diagrams showing the apparatus used in the dry transesterification process are provided in FIGS. 2A and 2B. FIG. 2A depicts apparatus associated with the dry transesterification reaction (i.e., pretreating, feeding, and combining reactants) and the continuous separation of the reaction products (i.e., FAME and glycerol fractions) of FIG. 1. FIG. 2B depicts apparatus associated with the purification of the reaction products and by-products, namely the removal of excess methanol from the FAME and glycerol fractions and the compression, condensation and drying of the recovered excess methanol.

Referring now to FIG. 1, alkali catalyst via stream 101 and fresh methanol via stream 102 are combined and mixed to form a methanol/catalyst feed solution in step 103 for combination with the triglycerides. Excess methanol recovered in the low pressure dry transesterification process may also be combined via path 130 in step 103 for formation of the methanol/catalyst feed solution. The feed solution of catalyst, fresh methanol, and recovered excess methanol is conveyed via path 104 for combination with the triglyceride feed of path 105. The methanol/catalyst feed solution and the triglyceride feed are combined and heated under the appropriate process conditions in step 106. This pretreated mixture of reactants from step 106 enters a low pressure agitated reactor vessel via stream 107, and is reacted in step 108 to produce the transesterification products, namely FAME and glycerol fractions. These reaction products, which include excess methanol, enter a decanter via path 109 for continuous separation in step 110. In step 110, the dry FAME fraction is continuously separated from the dry glycerol fraction in a manner so as to form a dry FAME fraction substantially and significantly free of glycerol. This continuous separation of the reaction products eliminates a washing step (i.e., the removal of glycerol from the FAME fraction via a water wash). Hereafter both the reaction fractions are purified (i.e., excess methanol is recovered from the fractions) as will be discussed after a presentation of the apparatus associated with the low pressure dry transesterification reaction and the continuous separation of the reaction products.

Referring now to FIG. 2A, fresh methanol is conveyed from storage by fresh methanol feed pump 302 for filtering in fresh methanol filters 303. Filtered fresh methanol is introduced into the methanol/catalyst mixing tank 305 via conduit 1. Excess recovered methanol may also be introduced into the methanol/catalyst mixing tank 305 via conduit 42. Catalyst stored in a catalyst hopper 370 is fed by gravity into a catalyst feeder 371 by a screw conveyer which delivers the catalyst into mixing tank 305 via conduit 2 for combination and mixing with the fresh filtered methanol and the excess recovered methanol.

Methanol/catalyst mix tank 305 has a centrally located agitator 304 driven by a motor which mixes the stored methanol, the recovered excess methanol and the catalyst together to form a feed solution. The feed solution formed by mixing the catalyst with the methanol is pumped from the tank by solution feed pump 306 via conduit 3 for combination with the triglycerides in low pressure reaction vessel 315. A portion of the methanol/catalyst feed solution is split prior to its combination with the triglyceride feed and sent via conduit 10 as a feed component to a second reaction vessel 325.

Vegetable oil from storage is conveyed by triglyceride feed pump 307 through triglyceride feed filters 308. A filtered triglyceride feed is fed via conduit 4 for combination with the methanol/catalyst feed solution. This combined reactor feed is carried by conduit 5 and is preheated by steam in heater 309 to a predetermined temperature. The heated reactants leave heater 309 via conduit 6 and enter low pressure reactor 315 which is equipped with agitator 314 which provides intimate contact of the reactants therein to thereby permit the transesterification reaction to take place.

The transesterification products include FAME and glycerol fractions, each of which has a methanol component. These reaction products exit reactor 315 via conduit 7 and enter a decanter 320 for continuous separation of the reaction fractions. Because the decantation is continuous, the purest FAME (i.e., the very top of the top layer in decanter 320) and the purest glycerol (i.e., the very bottom of the bottom layer in decanter 320) are separately and continuously recovered. The purity of the FAME recovered in this manner eliminates the need for any washing of glycerol from the FAME as is characteristic of the batch process, which thereby greatly reduces the costs associated with the wash columns of such batch processes.

The decanted dry FAME fraction, which is substantially free of glycerol, exits decanter 320 via conduit 8 and is combined with the split methanol/catalyst solution stream carried by conduit 10. This combined stream 11 is introduced into second low pressure reactor 325 equipped with agitator 324 where further transesterification occurs. Reactor effluent overflows out of the second reactor 325 into a second decanter 326 via conduit 12. This second decanter 326 is also continuous. The glycerol fraction exiting decanter 326 via conduit 14 is combined with the glycerol fraction exiting decanter 320 via conduit 9. This combined glycerol stream is conveyed by stripper feed pump 321 via conduit 15 to a glycerol/methanol stripping column 335 for purification of the glycerol. Reactor/decanter pump 327 conveys the light reaction products (i.e., substantially a FAME/methanol product) via conduit 13 to a FAME/methanol stripping column 330 for purification of the FAME.

Again, referring to the flow chart of FIG. 1, each of the continuously separated reaction fractions undergo processing to remove excess methanol and thereby purify the reaction product. The separated FAME fraction proceeds via path 111 to a dry vacuum extraction in step 113 for the removal of excess methanol. A clean dry FAME product is produced and exits the extraction step via path 115 while methanol vapors exit for subsequent treatment via path 114. The separated glycerol fraction undergoes similar treatment, proceeding via path 112 for dry vacuum extraction in step 116. Crude glycerine product exits the extraction step via path 117 while recovered methanol vapors exit for subsequent treatment via path 118.

Extracted methanol vapors from steps 113 and 116 are fed via paths 114 and 118 respectively for compression in a dry compressor in step 119. The compressed recovered methanol from step 119 proceeds via path 120 for condensing in an intercondenser via step 121. Any remaining methanol vapors proceed via path 122 for further compression in a second dry compressor in step 124, while the condensed methanol leaves the intercondenser via path 123. Methanol vapors condensed in step 124 proceed via path 125 for condensing in an aftercondenser in step 126. Noncondensibles exit the aftercondenser in step 126 via path 127 to a scrubber for ultimate disposal.

Condensed methanol vapors from the intercondenser in step 121 and the aftercondenser step 126 proceed via paths 123 and 128 respectively, for drying (i.e., continuous removal of any water than may be present in the recovered excess methanol) in step 129. Recovered water vapor exits drying step 129 via path 131 and continues to a scrubber for ultimate disposal. Dry recovered methanol exits drying step 129 via path 130 and may be fed for combination with fresh methanol feed 102 and catalyst feed 101 to form the feed solution in step 103.

Now referring to FIG. 2B which depicts the apparatus used to purify the transesterification reaction products after continuous separation (i.e., the separation and recovery of the methanol from the FAME and glycerol fractions). The FAME fraction pumped from reactor/decanter pump 327 enters an economizer 329 via conduit 13 where it is preheated by hot FAME leaving the FAME/methanol stripper 330 via FAME product pump 331 and conduit 18. The hot FAME of stream 18 is cooled in economizer 329 by the FAME fraction conveyed via conduit 13 by reactor/decanter pump 327. A cool, clean and dry FAME product leaves economizer 329 via conduit 19 for storage as shown.

The preheated FAME fraction leaves economizer 329 via conduit 16 and enters FAME/methanol stripper 330. Heat for the extraction is provided by a recirculating FAME stream 17 pumped by FAME product pump 331, and FAME/methanol stripping reboiler 332. Liquid methanol reflux, from excess methanol recovered elsewhere in the process, is introduced into the FAME/methanol stripper via conduit 24 to enhance purification of the FAME fraction.

The glycerol fraction is conveyed from decanters 320 and 326 by stripper feed pump 321 via conduit 15 to a glycerol/methanol stripper 335. Here, heat for the methanol extraction is provided by recirculating a portion of the glycerol product carried via conduit 34 via glycerol product pump 336 through glycerol/methanol stripper reboiler 337. Heated glycerol leaves reboiler 337 via conduit 33 and enters the glycerol/methanol stripper 335, while the glycerine product of conduit 34 is cooled via product cooler 339, and exits via conduit 35 for storage.

Methanol vapor leaving stripper 335 via conduit 43 receives cool condensed glycerine from glycerine cooler 352 via conduit 46, and is subsequently fed to glycerine condenser 350 whereby contact of the methanol vapor with the cool glycerine condenses any glycerine remaining in the methanol vapor. Condensed glycerine exits the condenser 350 via glycerine condenser pump 351 and conduit 44. A portion of the condensed glycerine product conveyed by pump 351 is removed via conduit 45 prior to cooling in cooler 352 for combination with the glycerol/methanol stripper feed carried by conduit 15. Recovered excess methanol exits the glycerine condenser 350 via conduit 36 for subsequent compression, condensing and drying.

Methanol vapor exiting FAME/methanol stripper 330 and glycerol condenser 350 via conduits 20 and 36 respectively are combined to form a first stage compressor feed carried by conduit 21. First stage compressor 390 is a dry mechanical compressor. Use of this type of compressor prevents water from entering the recovered methanol stream, thus maintaining the entire transesterification process substantially free of water. Compressed methanol vapor exits first stage compressor 390 via conduit 22 and enters methanol intercondenser 345, where the methanol vapor is contacted with cool liquid methanol entering the top of intercondenser 345 from intercondenser cooler 347 via conduit 28. Uncondensed methanol vapor leaves intercondenser 345 via conduit 29, while condensed methanol exits the methanol intercondenser 345 via conduit 23. Cooling for the methanol condensation is provided by recirculating the condensed methanol carried by conduit 23 through cooler 347 by intercondenser circulation pump 346. Condensed methanol is fed from pump 346 to intercondenser cooler 347 via conduit 25, while a portion of the condensed methanol is removed via conduit 24 prior to cooling in cooler 347 to provide reflux to FAME/methanol stripper 330. Cooled condensed methanol exits cooler 347 via conduit 26 for return to methanol intercondenser 345 via conduit 28, and for feeding desiccant column feed tank 355 via conduit 27.

Uncondensed methanol vapors enter second stage compressor 391, which is also a dry mechanical compressor, via conduit 29. Again, use of this type of compressor prevents water from entering the recovered methanol stream, thus maintaining the entire process in a dry condition. Compressed methanol vapors exit compressor 391 via conduit 30 for recovery in the shell and tube methanol aftercondenser 348 where any remaining methanol is condensed with cooling tower water. Non-condensibles exit after condenser 348 via conduit 32 for ultimate disposal to a scrubber. Condensed methanol leaves methanol aftercondenser 348 via stream 31 for collection in desiccant column feed tank 355.

Condensed recovered methanol from methanol intercondenser 345 and methanol aftercondenser 348 via conduits 27 and 31 respectively, enter desiccant column feed tank 355 and are conveyed therefrom by desiccant column feed pump 356 via conduit 37 for drying in desiccant columns 360A & 360B. Any minute amounts of water that have inadvertently entered the process through air leaks into the system or which were present in the raw materials (i.e., fresh methanol, triglyceride and catalyst) are removed by molecular sieves contained in the desiccant columns 360A & 360B, which are arranged in parallel. The molecular sieves trap the water molecules within their structure. When the capacity of the molecular sieves to trap water has been reached, the online column (i.e., 360A) undergoes heat regeneration while wet methanol is fed to the other column (i.e., 360B via conduit 39). Heat regeneration boils the water out of the molecular sieves. This relatively inexpensive and thus highly desirable method for drying the methanol is possible because great care has been taken to keep water out of the process. Dry recovered excess methanol exiting desiccant column 360A via conduit 40, or desiccant column 360B via conduit 41, is fed via conduit 42 to methanol/catalyst mix tank 305 for combination with the fresh methanol and catalyst to form the methanol/catalyst feed solution.

This low pressure dry transesterification process utilizing continuous separation of reaction products provides greater throughput over time than previous batch processes. The entire process provides an increased conversion of triglyceride to FAME product and improves the purity of both the FAME product and glycerol by-product. The great degree of purity achieved for these reaction products by this process is directly attributable to the use of the continuous separation step. The increased purity of the FAME product eliminates the need for a water wash for glycerol removal from the FAME, and when combined with a dry vacuum system for reaction product purification, drastically reduces the water content in the recovered excess methanol. This permits the use of desiccant columns equipped with molecular sieves to dry the methanol, instead of the previously required energy and capital intensive fractionation processes generally practiced for this purpose.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as followed in the true scope of the invention.

What is claimed is:

1. A low pressure process for the dry synthesis and continuous separation of products from the transesterification of triglycerides, comprising the steps of:

(a) providing a catalyst at a first predetermined rate and providing methanol at a second predetermined rate;

(b) mixing said catalyst and said methanol to form a feed solution;

(c) providing triglycerides at a third predetermined rate;

(d) mixing said triglycerides with said feed solution at a pressure, temperature and rate sufficient to produce a transesterified product having methyl ester and glycerol fractions, each of said fractions having a methanol component;

(e) continuously separating said methyl ester fraction from said glycerol fraction by decantation in a manner so as to produce a dry methyl ester fraction substantially free of glycerol, thereby eliminating washing of glycerol from said dry methyl ester fraction; and (f) recovering excess methanol from each of said fractions using a dry vacuum system so as to produce a clean methyl ester product from one of said fractions, a crude glycerin product from the other of said fractions and recovered excess methanol substantially free of water from each of said fractions.

2. The process of claim 1 wherein said catalyst is an alkali catalyst.

3. The process of claim 1 further comprising the step of removing any water that may be present in said recovered excess methanol to thereby ensure that said recovered excess methanol remains dry.

4. The process of claim 3 wherein said step of removing any water that may be present in said recovered excess methanol comprises adsorption.

5. The process of claim 4 wherein said adsorption is accomplished using molecular sieves.

6. The process of claim 4 further comprising the step of providing the dry recovered excess methanol for combination with said catalyst and said methanol to form said feed solution.

* * * * *